US009918369B2

(12) United States Patent
Zhang

(10) Patent No.: US 9,918,369 B2
(45) Date of Patent: Mar. 13, 2018

(54) LED BACKLIGHT DRIVING CIRCUIT AND METHOD FOR DETECTING FAILURE THEREOF

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 116 days.

(21) Appl. No.: 14/417,847

(22) PCT Filed: Jan. 19, 2015

(86) PCT No.: PCT/CN2015/071035
§ 371 (c)(1),
(2) Date: May 9, 2016

(87) PCT Pub. No.: WO2016/061919
PCT Pub. Date: Apr. 28, 2016

(65) Prior Publication Data

US 2016/0249432 A1 Aug. 25, 2016

(30) Foreign Application Priority Data

Oct. 20, 2014 (CN) ..... 2014 1 0557591

(51) Int. Cl.
*H05B 33/08* (2006.01)
*G09G 3/34* (2006.01)

(52) U.S. Cl.
CPC ..... *H05B 33/0893* (2013.01); *G09G 3/3406* (2013.01); *H05B 33/0815* (2013.01);
(Continued)

(58) Field of Classification Search
CPC ..... H05B 33/0893; H05B 33/0815; H05B 33/0827; H05B 33/0845
(Continued)

(56) References Cited

U.S. PATENT DOCUMENTS 5,463,284 A * 10/1995 Mattas ..... H05B 41/2828 315/227 R
9,485,815 B2 * 11/2016 Zhang ..... H05B 33/0815
(Continued)

FOREIGN PATENT DOCUMENTS

CN 1536544 A 10/2004
CN 201985857 U 9/2011
(Continued)

OTHER PUBLICATIONS

International Search Report and Written Opinion, dated Jan. 19, 2015, China.
(Continued)

*Primary Examiner* — Douglas W Owens
*Assistant Examiner* — Syed M Kaiser
(74) *Attorney, Agent, or Firm* — Kim Winston LLP

(57) ABSTRACT

Disclosed is an LED backlight driving circuit and method for detecting failure thereof. A driving chip of the circuit, on the one hand, is electrically connected to a control end of a booster unit so as to transmit a gate control signal to the booster unit, for regulating a driving voltage supplied by a power supply unit to an LED light strip through the booster unit, and on the other, is electrically connected between an output end of a detection unit and a negative end of the LED light strip, forming a current path of the LED light strip. When the detection unit outputs a variable testing voltage, the driving chip controls a current flowing through the LED light strip so that the current changes with the testing voltage, and judges whether to cut off its electrical connec-
(Continued)

tion to the LED light strip based on a comparison of a voltage on the negative end of the LED light strip and a predetermined threshold voltage.

20 Claims, 3 Drawing Sheets

(52) U.S. Cl.
CPC ..... *H05B 33/0827* (2013.01); *H05B 33/0845* (2013.01); *G09G 2330/04* (2013.01); *G09G 2330/12* (2013.01)

(58) Field of Classification Search
USPC ..... 315/122, 294, 291, 224, 307
See application file for complete search history.

(56) References Cited

U.S. PATENT DOCUMENTS

| | | | | |
|---|---|---|---|---|
| 9,534,773 | B1 * | 1/2017 | Turudic | F21V 23/005 |
| 2004/0095081 | A1 * | 5/2004 | Kernahan | H05B 41/2827 315/307 |
| 2004/0095111 | A1 * | 5/2004 | Kernahan | H02M 3/157 323/282 |
| 2004/0095114 | A1 * | 5/2004 | Kernahan | H02M 3/157 323/282 |
| 2004/0095115 | A1 * | 5/2004 | Kernahan | H02M 1/0845 323/282 |
| 2007/0257869 | A1 * | 11/2007 | Huang | G09G 3/3406 345/82 |
| 2008/0088550 | A1 * | 4/2008 | Kim | H02M 3/155 345/82 |
| 2011/0163682 | A1 * | 7/2011 | Jungwirth | H05B 33/0818 315/192 |
| 2011/0266972 | A1 * | 11/2011 | Ling | H05B 33/0827 315/297 |
| 2012/0043912 | A1 * | 2/2012 | Huynh | H05B 33/0827 315/297 |
| 2012/0146546 | A1 * | 6/2012 | Hu | H05B 33/0827 315/297 |
| 2013/0285571 | A1 * | 10/2013 | Li | H05B 33/0821 315/297 |

FOREIGN PATENT DOCUMENTS

| | | | |
|---|---|---|---|
| CN | 102637412 | A | 8/2012 |
| CN | 103021343 | A | 4/2013 |
| CN | 103117046 | A | 5/2013 |
| CN | 103295552 | A | 9/2013 |
| CN | 104282281 | A | 1/2015 |
| JP | 2011181378 | A | 9/2011 |
| JP | 2014108004 | A | 6/2014 |
| KR | 1020060038030 | A | 5/2006 |

OTHER PUBLICATIONS

Chinese Office Action and Search Report, dated Feb. 24, 2016, China.

* cited by examiner

LED BACKLIGHT DRIVING CIRCUIT AND METHOD FOR DETECTING FAILURE THEREOF

CROSS-REFERENCE TO RELATED APPLICATIONS

The present application claims benefit of Chinese patent application CN201410557591.2, entitled "LED backlight driving circuit and method for detecting failure thereof" and filed on Oct. 20, 2014, the entirety of which is incorporated herein by reference.

TECHNICAL FIELD

The present disclosure relates to backlight driving technologies of display panels, and in particular, to an LED backlight driving circuit and a method for detecting failure thereof.

TECHNICAL BACKGROUND

In the existing image display technologies, TFT liquid crystal display devices have distinguished themselves in virtue of their excellent properties, and have been widely used in various areas such as cell phones, computers, televisions, etc. Liquid crystal display devices achieve display of images by controlling transmittance of backlight source through causing non-luminous liquid crystal to deflect under the influence of voltage, and therefore, backlight module is an important part of liquid crystal display devices.

Currently, most of manufactures adopt an LED backlight system as shown in FIG. 1 as the backlight source of a liquid crystal display panel. This LED backlight system mainly comprises a power supply unit 110, a plurality of LED light strips 120, a booster unit 130 which is electrically connected between the power supply unit 110 and the plurality of LED light strips 120, and a driving chip 140 which is electrically connected between a plurality of the LED light strips 120 and the booster unit 130. The driving chip 140, on the one hand, based on a current and a voltage fed back by the LED light strips, transmits a gate control signal Vmos to a transistor 131 in the booster unit 130, for regulating a driving voltage Vout supplied by the power supply unit 110 to the LED light strips 120 through the booster unit 130, and on the other, based on the current and the voltage fed back by the LED light strips, regulates currents Iled flowing through the LED light strips 120 (i.e., regulating the brightness of the LED lights) by modulating PWM duty ratio under the influence of an operating voltage Va.

In addition, the driving chip 140 is also able to detect failure of the LED light strips. Specifically, the driving chip detects voltages on negative ends of the LED light strips (i.e., detecting a difference between the driving voltage Vout and a voltage actually needed by the LED light strips). When a certain LED light strip fails so that a voltage on the negative end thereof is higher than a predetermined threshold voltage, the driving chip will activate a self-protection function and thus cut off its electrical connection to said LED light strip. Usually, the threshold voltage is a set value of the driving chip, which is often one of 3V, 6V, 9V or 12V.

However, the inventor found through repeated observations that the above driving chip often provides wrong judgments in practice. This is because the LED light strips may have different electrical properties, and may actually require different voltages when a same current flows through them, which causes voltages on the negative ends of each of the LED light strips to be different. For example, if an LED light strip has a small resistance, and it can work normally but a voltage on its negative end is higher than the threshold voltage, the driving chip will activate the protection function and then cut off its electrical connection to said LED light strip. Or, if an LED light strip fails, but a voltage on its negative end is not higher than the threshold voltage, the driving chip will not activate the protection function. In particular, if there is only one LED light in an LED light strip that is short-circuited or virtually off, it will be very difficult for the driving chip to identify the failure because the voltage on its negative end will not vary much and will not be higher than the threshold voltage. In addition, due to the obstruction of fittings such as the light guide plate and films disposed within the backlight module, it will also be difficult to detect the failure manually. Thus, the circuit abnormity will continue to be present and become worse, thereby causing safety problems.

SUMMARY OF THE INVENTION

To solve the above problem, the present disclosure provides an LED backlight driving circuit, and a method for accurately detecting failure of the LED backlight driving circuit.

The LED backlight driving circuit provided in the present disclosure comprises:

a power supply unit; an LED light strip; a booster unit which is connected between an output end of the power supply unit and a positive end of the LED light strip; a detection unit which outputs a fixed operating voltage in a normal mode and a variable testing voltage in a testing mode; and a driving chip, which, on the one hand, is electrically connected to a control end of the booster unit so as to transmit a gate control signal to the booster unit, for regulating a driving voltage supplied by the power supply unit to the LED light strip through the booster unit, and on the other, is electrically connected between an output end of the detection unit and a negative end of the LED light strip, forming a current path of the LED light strip. When the detection unit outputs the fixed operating voltage, the driving chip regulates a current flowing through the LED light strip by modulating PWM duty ratio. When the detection unit outputs the variable testing voltage, the driving chip controls the current flowing through the LED light strip so that the current changes with the testing voltage, and judges whether to cut off its electrical connection to the LED light strip based on a comparison of a voltage on the negative end of the LED light strip and a predetermined threshold voltage.

Further, when the detection unit outputs the fixed operating voltage, the driving chip also judges whether to cut off its electrical connection to the LED light strip based on the comparison of the voltage on the negative end of the LED light strip and the predetermined threshold voltage.

According to the embodiments of the present disclosure, the booster unit comprises: an inductor, which is electrically connected to the output end of the power supply unit at one end thereof; a rectifier diode, which is electrically connected to the other end of the inductor at an anode thereof, and to the positive end of the LED light strip at a cathode thereof; an electrolytic capacitor, which is electrically connected to the cathode of the rectifier diode at one end thereof, and to ground at the other end thereof; and a transistor, which is connected to the anode of the rectifier diode at a drain thereof, and is electrically connected to ground at a source thereof, a control end of the transistor serving as the control end of the booster unit.

According to the embodiments of the present disclosure, the detection unit comprises: a first input end, for receiving the operating voltage; a second input end, for receiving the testing voltage; a third input end, for receiving a voltage signal of a mode-switching instruction; a switching diode, which is electrically connected to the first input end at an anode thereof, and to the second input end at a cathode thereof, the cathode of the switching diode serving also as the output end of the detection unit; and a switching transistor, which is electrically connected to the anode of the switching diode at a drain thereof, to ground at a source thereof, and to the third input end at a control end thereof.

Specifically, the first input end of the detection unit receives the operating voltage in the normal mode, and the second input end of the detection unit receives the testing voltage in the testing mode. The switching transistor is switched on based on the voltage signal of the mode-switching instruction, so that the detection unit is switched from the normal mode to the testing mode.

Specifically, the detection unit outputs the variable testing voltage in the testing mode, enabling the current flowing through the LED light strip to decrease gradually, thereby increasing the voltage on the negative end of the LED light strip gradually.

According to the embodiments of the present disclosure, a voltage needed by a single LED is 6V, and the threshold voltage may be set to 9V.

In addition, the present disclosure further provides a method for detecting failure of the above-said LED backlight driving circuit, which comprises the following steps.

In step S100, a voltage signal of a mode-switching instruction is supplied to a third input end of a detection unit, so that the detection unit can be switched from a normal mode to a testing mode.

In step S200, a variable testing voltage is supplied to a second input end of the detection unit, enabling a current flowing through each of LED light strips to decrease gradually, thereby increasing a voltage on each of negative ends of the LED light strips gradually.

In step S300, when a voltage on a negative end of a certain LED light strip is higher than a threshold voltage, a driving chip cuts off its electrical connection to said LED light strip.

In step S400, failure of the LED light strips is judged based on whether the LED light strips have gone out.

According to the embodiments of the present disclosure, in step S400, if only one LED light strip goes out, and other LED light strips glow, it is determined that a short circuit is present in said one LED light strip.

According to the embodiments of the present disclosure, in step S400, if only one LED light strip glows, and other LED light strips go out, it is determined that an LED light in said one LED light strip is virtually off Compared with existing technologies, the present disclosure achieves the following beneficial effects. The embodiments of the present disclosure have introduced improvements on the existing LED backlight driving circuit by adding a detection unit. The detection unit supplies the fixed operating voltage to the driving chip in the normal mode, and supplies the variable testing voltage to the driving chip in the testing mode. In the testing mode, magnitude of the current flowing through the LED light strip is instantly decreased by adjusting the testing voltage, enabling the voltage on the negative end of the LED light strip to be increased. Then, presence of a short circuit or a virtual-off state of the LED light strip could be determined accurately based on whether the LED light strip has gone out or not because the voltage on its negative end is higher than the threshold voltage of the driving chip. The present disclosure is able to accurately determine, in particular, abnormity of a single light in the LED light strip.

BRIEF DESCRIPTION OF THE DRAWINGS

The accompanying drawings are provided for a further understanding of the present disclosure, and for illustrating the present disclosure together with the embodiments of the present disclosure. They constitute a part of the description, and are not intended to limit the present disclosure.

DETAILED DESCRIPTION OF THE EMBODIMENTS

Figure 1:
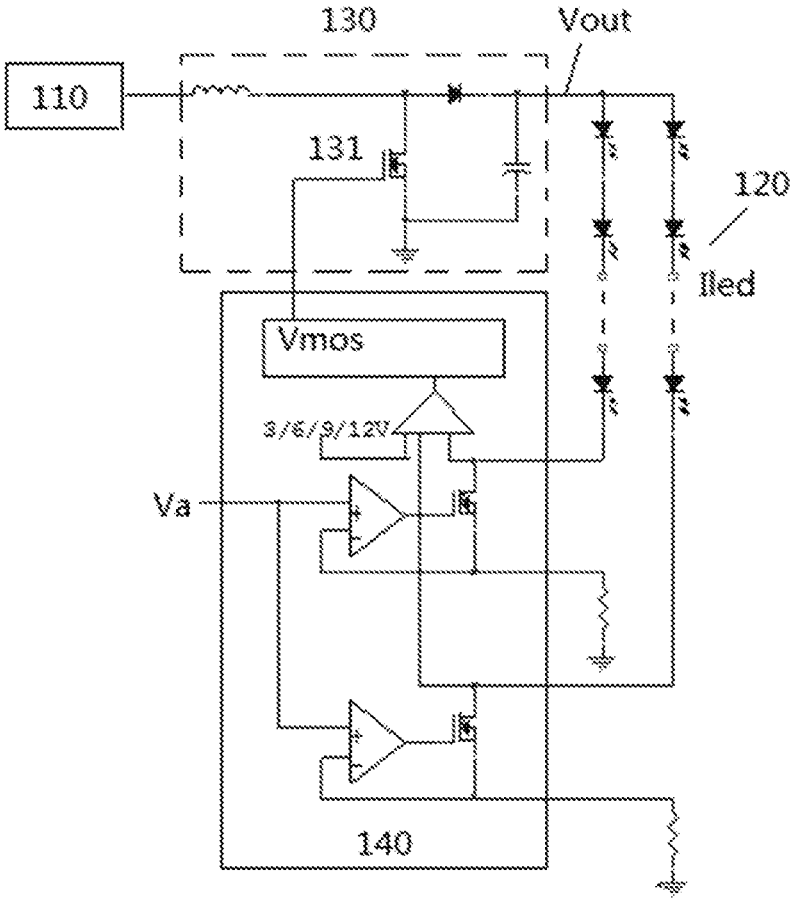
Fig. 1 (PRIOR ART)
FIG. 1 schematically shows structure of a circuit of an LED backlight system according to the existing technologies.
Figure 2:
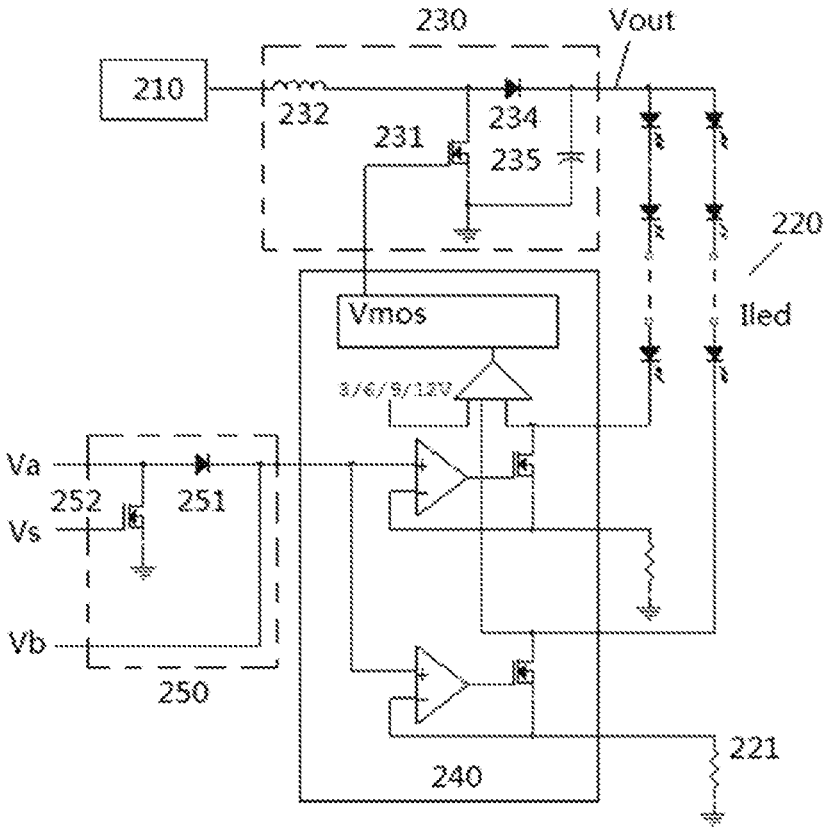
FIG. 2 schematically shows structure of an LED backlight driving circuit according to the embodiments of the present disclosure.

As shown in FIG. 2, to solve the above technical problem, according to the present disclosure improvements are proposed on the existing LED backlight driving circuit. It can be seen from FIG. 2 that the LED backlight driving circuit provided by the present disclosure comprises: a power supply unit 210; a plurality of LED light strips 220; a booster unit 230 which is electrically connected between the power supply unit 210 and the plurality of LED light strips 220; a driving chip 240 which is electrically connected between the plurality of LED light strips 220 and the booster unit 230; as well as a detection unit 250 which is electrically connected to the driving chip 240. The detection unit 250 is able to supply a fixed operating voltage Va to the driving chip 240 in a normal mode, and supply a variable testing voltage Vb to the driving chip 240 in a testing mode.

A detailed description will be provided below to the specific arrangement of each of the above functional units in the LED backlight driving circuit with reference to FIG. 2. It should be noted that details of the description to be followed are intended only for a better understanding of the present disclosure, and that the present disclosure could also be implemented in other different ways. Therefore, the present disclosure is not limited to specific embodiments provided as follows.

An output end of the power supply unit 210 is connected to an input end of the booster unit 230, for supplying a power supply voltage to the booster unit 230.

The booster unit 230 comprises a transistor 231, an inductor 232, a rectifier diode 234, and an electrolytic capacitor 235. An end of the inductor 232 serving as the input end of the booster unit 230 is connected to an output end of the power supply unit 210. The other end of the inductor 232 is connected to an anode of the rectifier diode 234. A cathode of the rectifier diode 234 is electrically connected to ground through the electrolytic capacitor 235, and meanwhile serves as an output end of the booster unit 230 and is connected to positive ends of the LED light strips 220, for supplying a driving voltage Vout to the LED light strips 220. A drain of the transistor 231 is connected to the anode of the rectifier diode 234, and a source thereof is electrically connected to ground, and a control end of the transistor 231 serving as a control end of the booster unit 230 is connected to the driving chip 240.

A control signal output end of the driving chip 240 is connected to the control end of the booster unit 230, so as to supply a gate control signal Vmos to the booster unit 230, for regulating the driving voltage Vout supplied by the power supply unit 210 to the LED light strips 220 through the booster unit 230. The driving chip 240, on the one hand, is connected to an output end of the detection unit 250, and on the other, is connected to negative ends of each of the LED light strips 220 through a plurality of pins, thus forming a complete current path. The internal circuitry of the driving chip 240 and the electrical connection between the driving chip 240 and each of the LED light strips 220 are known in the art, and therefore will not be described herein in detail.

The detection unit 250 comprises a switching diode 251 and a switching transistor 252. An anode of the switching diode 251 serves as a first input end and receives the fixed operating voltage Va, and a cathode thereof serves as a second input end and receives the variable testing voltage Vb. The cathode of the switching diode 251 also serves as the output end of the detection unit 250 and is connected to the driving chip 240. A drain of the switching transistor 252 is connected to the anode of the switching diode 251, and a source thereof is electrically connected to ground. A control end of the switching transistor 252 serves as a third input end of the detection unit 250 and receives a voltage signal Vs of a mode-switching instruction. When the switching transistor 252 electrically connected to ground is switched on, the detection unit 250 is switched to the testing mode.

A detailed description to operating principles of the above-said LED backlight driving circuit will be provided below.

1) In the normal mode:

The first input end of the detection unit 250 receives the fixed operating voltage Va. Under the influence of the operating voltage Va, the switching diode 251 of the detection unit 250 is switched on, thereby delivering the operating voltage Va to the driving chip 240. Under the influence of the operating voltage Va, the driving chip 240 switches on the current paths of the LED light strips 220. In this case, magnitude of a current Iled in the current path of each of the LED light strips 210 is Va/RL, which is a set value. RL represents the resistance value of a resistor 221 arranged in the current path of each of the LED light strips, which will not be described herein in detail because it is known in the art.

2) In the testing mode:

The third input end of the detection unit 250 receives the voltage signal Vs which is higher than a threshold voltage of the switching transistor 252, enabling the switching transistor 252 to be kept in a switched-on state, and in the meantime, the second input end of the detection unit 250 receives the variable testing voltage Vb.

Since the switching transistor 252 electrically connected to ground is switched on, the detection unit 250 delivers the testing voltage Vb to the driving chip 240. Under the influence of the testing voltage Vb, the driving chip 240 switches on the current paths of the LED light strips 220. In this case, the magnitude of the current Iled in the current path of each of the LED light strips 220 is Vb/RL, which is a variable varies with the testing voltage Vb.

Based on the above circuit, the inventor put forward that, in the testing mode, the magnitude of the current in each of the current path of the LED light strips 220 can be decreased by varying the testing voltage Vb, thereby realizing the objective of accurately detecting the failure of the LED light strips. In the text to be followed, examples will be used to illustrate steps and principles of implementing the method for detecting the failure.

Figure 3:
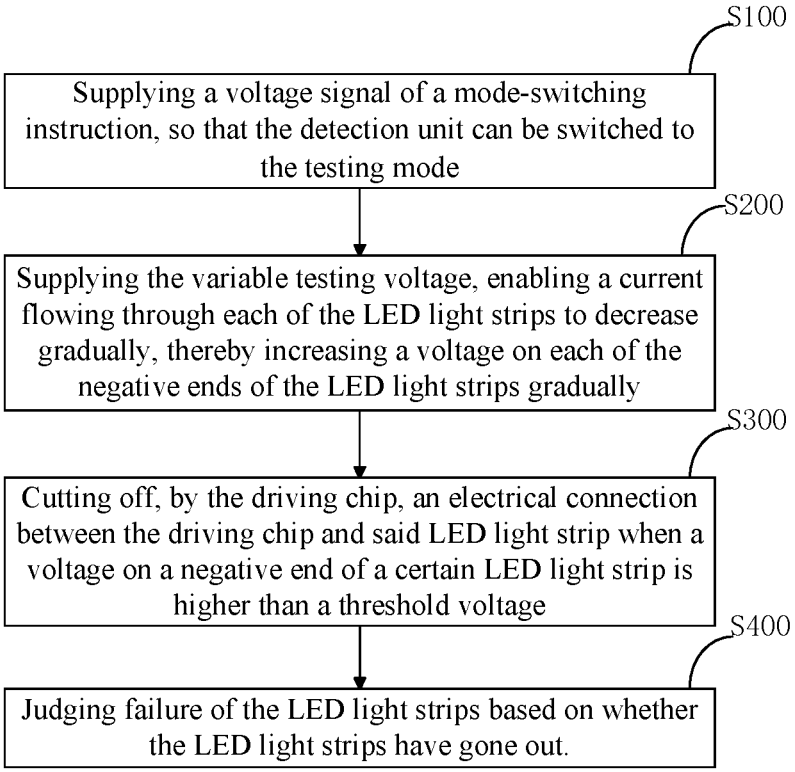
FIG. 3 shows a flow chart of a method for detecting failure of the LED backlight driving circuit according to the embodiments of the present disclosure.

As shown in FIG. 3, the voltage signal of the mode-switching instruction is first supplied to the third input end of the detection unit, so that the switching transistor electrically connected to ground can be switched on, thereby enabling the detection unit to work in the testing mode. Then, the variable testing voltage Vb is supplied to the second input end of the detection unit, enabling the current flowing through each of the LED light strips to decrease gradually, thereby increasing the voltage on each of the negative ends of the LED light strips. During this process, the status of each of the LED light strips is observed.

If only one LED light strip goes out, and other LED light strips glow, it can be determined that a short circuit is present in said one LED light strip. This is because if there is one LED light that is short-circuited in an LED light strip, resistance of said light LED light strip will be decreased, and a voltage actually needed by said LED light strip will be lower than normally needed, which will cause the voltage on the negative end of the failed LED light strip to be higher than the voltages on the negative ends of the normally working LED light strips. Therefore, when the magnitude of the current is decreased by repeatedly adjusting the testing voltage, the voltage on the negative end of the LED light strip with a short circuit will first reach the threshold voltage, thereby causing the driving chip to activate a protection function, and thus causing the LED light strip to go out.

If only one LED light strip glows, and other LED light strips go out, it can be determined that an LED light in said one LED light strip is virtually off. This is because if there is one LED light that is virtually off in an LED light strip, resistance of said light LED light strip will be increased, and a voltage actually needed by said LED light strip will be higher than normally needed, which will render the driving voltage Vout higher than a normal value, thereby causing the voltages on the negative ends of other normally working LED light strips to be higher than the voltage on the negative end of the failed LED light strip. Therefore, when the magnitude of the current is decreased by repeatedly adjusting the testing voltage, the voltages on the negative ends of the normally working LED light strips will first reach the threshold voltage, thereby causing the driving chip to activate the protection function, and thus causing these normally working LED light strips to go out, leaving the virtually-off LED light strip glowing.

Further, in order to reduce and even avoid wrong judgments of the driving chip in normal working state, the threshold voltage of the driving chip can be set higher. For example, if a voltage needed by a single LED is 6V, the threshold voltage can be set to 9V.

In summary, the present disclosure takes advantage of the property that voltages on two ends of the LED light strip vary with magnitude of the current flowing through it. By instantly reducing magnitude of the current flowing through the LED light strip, the voltage on the negative end of the LED light strip is increased. And then, failure of the LED light strip is determined based on whether the LED light strip has gone out or not because the voltage on its negative end is higher than the threshold voltage of the driving chip. The present disclosure is applicable particularly to detecting failure of a single LED light in an LED light strip, and solves the problem that in the existing technologies, it is difficult to detect failure of a single LED light. The present disclosure improves, to some degree, the reliability of backlight sources of display panels.

The above embodiments are described only for better understanding, rather than restricting the present disclosure. Anyone skilled in the art can make amendments to the implementing forms or details without departing from the spirit and scope of the present disclosure. The scope of the present disclosure should still be subject to the scope defined in the claims.

The invention claimed is:

1. An LED backlight driving circuit, comprising:

a power supply unit, an LED light strip, a booster unit, which is electrically connected between an output end of the power supply unit and a positive end of the LED light strip, a detection unit, which outputs a fixed operating voltage in a normal mode and a variable testing voltage in a testing mode, and a driving chip, which is electrically connected to a control end of the booster unit so as to transmit a gate control signal to the booster unit, for regulating a driving voltage supplied by the power supply unit to the LED light strip through the booster unit, and is electrically connected between an output end of the detection unit and a negative end of the LED light strip, forming a current path of the LED light strip, wherein when the detection unit outputs the fixed operating voltage, the driving chip regulates a current flowing through the LED light strip by modulating PWM duty ratio, and when the detection unit outputs the variable testing voltage, the driving chip controls the current flowing through the LED light strip so that the current changes with the testing voltage, and judges whether to cut off its electrical connection to the LED light strip based on a comparison of a voltage on the negative end of the LED light strip and a predetermined threshold voltage.

2. The LED backlight driving circuit according to claim 1, wherein when the detection unit outputs the fixed operating voltage, the driving chip also judges whether to cut off its electrical connection to the LED light strip based on the comparison of the voltage on the negative end of the LED light strip and the predetermined threshold voltage.

3. The LED backlight driving circuit according to claim 1, wherein the booster unit comprises:

an inductor, which is electrically connected to the output end of the power supply unit at one end thereof, a rectifier diode, which is electrically connected to the other end of the inductor at an anode thereof, and to the positive end of the LED light strip at a cathode thereof, an electrolytic capacitor, which is electrically connected to the cathode of the rectifier diode at one end thereof, and to ground at the other end thereof, and a transistor, which is connected to the anode of the rectifier diode at a drain thereof, and is electrically connected to ground at a source thereof, a control end of the transistor serving as the control end of the booster unit.

4. The LED backlight driving circuit according to claim 2, wherein the booster unit comprises:

an inductor, which is electrically connected to the output end of the power supply unit at one end thereof, a rectifier diode, which is electrically connected to the other end of the inductor at an anode thereof, and to the positive end of the LED light strip at a cathode thereof, an electrolytic capacitor, which is electrically connected to the cathode of the rectifier diode at one end thereof, and to ground at the other end thereof, and a transistor, which is connected to the anode of the rectifier diode at a drain thereof, and is electrically connected to ground at a source thereof, a control end of the transistor serving as the control end of the booster unit.

5. The LED backlight driving circuit according to claim 1, wherein the detection unit comprises:

a first input end, for receiving the operating voltage, a second input end, for receiving the testing voltage, a third input end, for receiving a voltage signal of a mode-switching instruction, a switching diode, which is electrically connected to the first input end at an anode thereof, and to the second input end at a cathode thereof, the cathode of the switching diode also serving as the output end of the detection unit, and a switching transistor, which is electrically connected to the anode of the switching diode at a drain thereof, to ground at a source thereof, and to the third input end at a control end thereof.

6. The LED backlight driving circuit according to claim 2, wherein the detection unit comprises:

a first input end, for receiving the operating voltage, a second input end, for receiving the testing voltage, a third input end, for receiving the voltage signal of the mode-switching instruction, a switching diode, which is electrically connected to the first input end at an anode thereof, and to the second input end at a cathode thereof, the cathode of the switching diode also serving as the output end of the detection unit, and a switching transistor, which is electrically connected to the anode of the switching diode at a drain thereof, to ground at a source thereof, and to the third input end at a control end thereof.

7. The LED backlight driving circuit according to claim 3, wherein the detection unit comprises:

a first input end, for receiving the operating voltage, a second input end, for receiving the testing voltage, a third input end, for receiving the voltage signal of the mode-switching instruction, a switching diode, which is electrically connected to the first input end at an anode thereof, and to the second input end at a cathode thereof, the cathode of the switching diode also serving as the output end of the detection unit, and a switching transistor, which is electrically connected to the anode of the switching diode at a drain thereof, to ground at a source thereof, and to the third input end at a control end thereof.

8. The LED backlight driving circuit according to claim 4, wherein the detection unit comprises:

a first input end, for receiving the operating voltage, a second input end, for receiving the testing voltage, a third input end, for receiving the voltage signal of the mode-switching instruction, a switching diode, which is electrically connected to the first input end at an anode thereof, and to the second input end at a cathode thereof, the cathode of the switching diode also serving as the output end of the detection unit, and a switching transistor, which is electrically connected to the anode of the switching diode at a drain thereof, to ground at a source thereof, and to the third input end at a control end thereof.

9. The LED backlight driving circuit according to claim 5, wherein, the first input end of the detection unit receives the operating voltage in the normal mode, the second input end of the detection unit receives the testing voltage in the testing mode, and the switching transistor is switched on based on the voltage signal of the mode-switching instruction, so that the detection unit is switched from the normal mode to the testing mode.

10. The LED backlight driving circuit according to claim 6, wherein, the first input end of the detection unit receives the operating voltage in the normal mode, the second input end of the detection unit receives the testing voltage in the testing mode, and the switching transistor is switched on based on the voltage signal of the mode-switching instruction, so that the detection unit is switched from the normal mode to the testing mode.

11. The LED backlight driving circuit according to claim 7, wherein, the first input end of the detection unit receives the operating voltage in the normal mode, the second input end of the detection unit receives the testing voltage in the testing mode, and the switching transistor is switched on based on the voltage signal of the mode-switching instruction, so that the detection unit is switched from the normal mode to the testing mode.

12. The LED backlight driving circuit according to claim 8, wherein, the first input end of the detection unit receives the operating voltage in the normal mode, the second input end of the detection unit receives the testing voltage in the testing mode, and the switching transistor is switched on based on the voltage signal of the mode-switching instruction, so that the detection unit is switched from the normal mode to the testing mode.

13. The LED backlight driving circuit according to claim 5, wherein the detection unit outputs the variable testing voltage in the testing mode, enabling the current flowing through the LED light strip to decrease gradually, thereby increasing the voltage on the negative end of the LED light strip gradually.

14. The LED backlight driving circuit according to claim 6, wherein the detection unit outputs the variable testing voltage in the testing mode, enabling the current flowing through the LED light strip to decrease gradually, thereby increasing the voltage on the negative end of the LED light strip gradually.

15. The LED backlight driving circuit according to claim 9, wherein the detection unit outputs the variable testing voltage in the testing mode, enabling the current flowing through the LED light strip to decrease gradually, thereby increasing the voltage on the negative end of the LED light strip gradually.

16. The LED backlight driving circuit according to claim 10, wherein the detection unit outputs the variable testing voltage in the testing mode, enabling the current flowing through the LED light strip to decrease gradually, thereby increasing the voltage on the negative end of the LED light strip gradually.

17. The LED backlight driving circuit according to claim 1, wherein a voltage needed by a single LED is 6V, and the threshold voltage is set to 9V.

18. A method for detecting failure of an LED backlight driving circuit, wherein, the LED backlight driving circuit comprises a power supply unit, an LED light strip, a booster unit, a detection unit, and a driving chip; the booster unit is connected between an output end of the power supply unit and a positive end of the LED light strip; the detection unit outputs a fixed operating voltage in a normal mode and a variable testing voltage in a testing mode; and the driving chip, on the one hand, is electrically connected to a control end of the booster unit so as to transmit a gate control signal to the booster unit, for regulating a driving voltage supplied by the power supply unit to the LED light strip through the booster unit, and on the other, is electrically connected between an output end of the detection unit and a negative end of the LED light strip, forming a current path of the LED light strip, the method for detecting failure comprises the following steps:

step S100, supplying a voltage signal of a mode-switching instruction to a third input end of the detection unit, so that the detection unit can be switched from the normal mode to the testing mode, step S200, supplying the variable testing voltage to the second input end of the detection unit, enabling a current flowing through each of the LED light strips to decrease gradually, thereby increasing a voltage on each of the negative ends of the LED light strips gradually, step S300, cutting off, by the driving chip, an electrical connection between the driving chip and said LED light strip when a voltage on a negative end of a certain LED light strip is higher than a threshold voltage, and step S400, judging failure of the LED light strips based on whether the LED strips have gone out.

19. The method for detecting failure according to claim 18, wherein in step S400, if only one LED light strip goes out, and other LED light strips glow, it is determined that a short circuit is present in said one LED light strip.

20. The method for detecting failure according to claim 18, wherein in step S400, if only one LED light strip glows, and other LED light strips go out, it is determined that an LED light in said one LED light strip is virtually off.

* * * * *